US007121061B2

(12) United States Patent
Jazzar

(10) Patent No.: US 7,121,061 B2
(45) Date of Patent: Oct. 17, 2006

(54) REINFORCED CONCRETE BUILDING SYSTEM

(76) Inventor: Omar Abdul Latif Jazzar, P.O. Box 12543, Jeddah, Western Province (SA) 21483

( * ) Notice: Subject to any disclaimer, the term of this patent is extended or adjusted under 35 U.S.C. 154(b) by 428 days.

(21) Appl. No.: 10/725,151

(22) Filed: Dec. 1, 2003

(65) Prior Publication Data

US 2004/0118080 A1 Jun. 24, 2004

Related U.S. Application Data

(63) Continuation-in-part of application No. PCT/IB02/01926, filed on May 31, 2002.

(30) Foreign Application Priority Data

Jun. 2, 2001 (SA) ..... GCC/1408/2001

(51) Int. Cl.
*E04B 1/00* (2006.01)

(52) U.S. Cl. ..... 52/745.13; 52/251; 52/259; 52/236.8

(58) Field of Classification Search ..... 52/319, 52/379, 380, 414, 236.8, 251, 745.13, 259; 249/33, 31, 23, 18, 19, 20
See application file for complete search history.

(56) References Cited

U.S. PATENT DOCUMENTS

| | | | | |
|---|---|---|---|---|
| 1,501,288 | A * | 7/1924 | Morley | 52/236.8 |
| 1,516,074 | A | 11/1924 | Bong | |
| 2,043,697 | A * | 6/1936 | Deichmann | 52/372 |
| 3,604,177 | A * | 9/1971 | Clyne et al. | 52/283 |
| 3,818,660 | A | 6/1974 | Dillon | |
| 3,949,531 | A * | 4/1976 | Fanson | 52/380 |
| 3,959,423 | A * | 5/1976 | Boyd | 264/34 |
| 4,065,907 | A * | 1/1978 | Rice | 52/745.13 |
| 4,095,380 | A | 6/1978 | Dillon | |
| 4,191,002 | A * | 3/1980 | Rice | 52/745.03 |
| 4,263,757 | A * | 4/1981 | Thys | 52/79.1 |
| 4,616,459 | A * | 10/1986 | Shubow | 52/309.12 |
| 5,081,805 | A | 1/1992 | Jazzar | |
| 5,177,924 | A * | 1/1993 | Kakuk | 52/606 |
| 5,205,943 | A | 4/1993 | Jazzar | |
| 5,493,838 | A * | 2/1996 | Ross | 52/745.1 |
| 5,987,827 | A * | 11/1999 | Lord | 52/274 |
| 2002/0104281 | A1 * | 8/2002 | Sanger | 52/319 |

FOREIGN PATENT DOCUMENTS

| | | |
|---|---|---|
| AT | 267816 B | 1/1969 |
| DE | 1409923 A | 5/1969 |
| DE | 2354716 | 5/1974 |
| EP | 363544 A1 | 4/1990 |

* cited by examiner

*Primary Examiner*—Naoko Slack
*Assistant Examiner*—Jessica Laux
(74) *Attorney, Agent, or Firm*—David Kiewit

(57) ABSTRACT

A method of forming a portion of a monolithic concrete building provides for two-dimensional support of horizontally extensive portions of the building at all times and thus reduces the strength required of the vertically extensive supports. The method employs flanged wall members having horizontal extents substantially equal to the selected room size. Each of the wall members has at least one flange extending horizontally towards a parallel facing wall member by about ten to twenty five percent of the intramural separation between the walls of the room being constructed. Horizontal floor or ceiling slabs that link the horizontal flanges may be cast in situ using a form plate supported by a temporary trussed joist.

11 Claims, 6 Drawing Sheets

REINFORCED CONCRETE BUILDING SYSTEM

CROSS REFERENCE TO OTHER APPLICATIONS

This application is a continuation in part of the inventor's PCT application PCT/IB02/01926, filed May 31, 2002, which claims the priority of the Cooperation Council for the Arab States of the Gulf provisional application number GCC/1408/2001, filed Jun. 2, 2001.

FIELD OF THE INVENTION

This invention relates to concrete building units that may be pre-cast or cast in situ to provide a continuous cementitious structure comprising inflexible rigid corners that redistribute loads and moments so that less concrete is needed.

BACKGROUND OF THE INVENTION

A precast concrete building unit of half-room configuration with a web portion (which may form a ceiling, a floor, or a ceiling of a room on one storey of a multi-storey building and the floor of the storey above it) and opposite half-wall defining flange portions was taught by the inventor in his U.S. Pat. No. 5,081,805, the disclosure of which is herein incorporated by reference. The structure taught in that patent uses matching ridge and depression insert elements placed in a mold forming the bases of the flanges with mating tongue and groove shear keys when the units are connected flange-to-flange as upright/inverted unit pairs to form whole rooms. Staggered blocks mounted on the top edges of the top plates project into the mold to form interlocking bearing surfaces for mating diagonally positioned web-to-web upright/inverted unit pairs. Units formed in the same mold can be used for rooms, columns, shear walls, retaining walls, elevator shafts, stairwells, girders and pedestrian bridges.

In the inventor's U.S. Pat. No. 5,205,943, he teaches that a U-shaped, half-room precast concrete building unit can be molded in an open box-like framework having four L-shaped corner assemblies, facing pairs of horizontal legs of which are respectively joined by laterally-extending telescoping spacers, and facing pairs of vertical legs of which are respectively each joined by two laterally-spaced longitudinally-extending plates. Inserts having alternating voids and blocks are placed longitudinally between the vertical leg pairs to form complementary block and void patterns on the molded unit juncture edges. Retainers having projections are placed over the top edges of the plates to form complementary tongue and groove portions. Relative dimensions of the molded unit are selectable through adjustment of the relative positions of the corner assemblies. The teaching of U.S. Pat. No. 5,205,943 is herein incorporated by reference.

In U.S. Pat. No. 1,516,074 Borg teaches a method of making a monolithic concrete structure in which a plurality of slabs are supported by another plurality of columns. Borg does not teach the use of a wall member having a length essentially coextensive with that of a wall. Moreover, Borg does not teach providing two dimensional support of horizontally extensive portions of his structure while the structure is being grouted together.

SUMMARY OF THE INVENTION

Objects of some embodiments of the invention include simplifying the manufacturing of structures using pre-cast elements, reducing the weight of the pre-cast elements that are used, and increasing the maximum distance spanned by horizontal slabs that may serve as a ceiling, a floor, or a ceiling of one storey in a multi-storey building and also as the floor in the storey above it. In a preferred embodiment, this is accomplished by using inflexible rigid corners to redistribute the moments and to thereby reduce both the moments and the deflections in the loaded slabs or in any other adjacent connected element, be it a wall adjacent slab or a ceiling. In preferred embodiments, these inflexible corners can be viewed as a vertical wall that bends ninety degrees and continues horizontally as a flange portion for about a meter. Flange portions are provided both at the top of the wall and at the bottom, and the two horizontal flange portions have reduced thickness rabbet sections at their ends distal from the wall. In particular preferred embodiments, the reduced thickness is about half of the horizontal flange thickness, and the reduced thickness section extends about twenty centimeters in from the distal end of each flange.

One aspect of the invention is that it provides a method for making a monolithic reinforced concrete portion of a building comprising two vertical facing walls having a common wall length, where the facing walls are spaced apart by a selected intramural spacing. A first step in this method comprises erecting two flanged wall members, each of which has a respective vertical wall portion having a horizontal width substantially equal to the wall length and having at least one horizontal flange portion extending outward from the vertical wall portion by a selected horizontal length lying in a range between 10% and 25% of the selected intramural spacing. These wall members are erected in a parallel facing relationship so that the two flange portions extend toward each other. Each of the preferred horizontal flange portions comprises a respective rabbeted end portion distal from the wall portion and has a respective at least one reinforcing member at least partly embedded in it. Each of these preferred reinforcing members extends along both the vertical wall portion and the horizontal flange portion of the respective wall member and also extends away from its associated vertical wall portion by more than the selected horizontal length of the flange so that ends of some of the reinforcing members distal from the associated wall portion extend outwardly from their respective rabbeted flange end portion. A second step in the process comprises supporting a form plate in a sealing relationship against a lower surface of each of the rabbeted end portions of the two horizontal flange portions by supporting means attached to both of the at least two wall members, and a third step comprises pouring concrete onto the form plate to form a slab linking the two wall members thereby forming the monolithic reinforced concrete portion of the building.

Another aspect of the invention is that it provides a method for making a monolithic reinforced concrete portion of a building enclosing a generally rectangular room having a selected floor-to-ceiling height and having first and second selected wall widths, each of which is greater than the floor-to-ceiling height. A first step in the preferred method comprises erecting four or more flanged wall members, each of which comprises at least one respective vertical wall portion and at least one respective horizontal flange portion. These wall members are erected pair-wise in parallel facing arrangements so that a respective vertical wall portion of each wall member is parallel to the wall portion of one of the other three wall members and is spaced apart from it by one of the first and second wall widths. Moreover, a respective horizontal flange portions associated with each of the wall members extend outwardly, at a common height, from the respective wall portions by less than 25% of the one of the first and second wall widths, thereby defining a generally rectangular void bounded by the four horizontal flange portions. A subsequent step in this process involves supporting a form plate in a sealing relationship against a lower surface of each of the four horizontal flange portions so as to bridge the void between the flange ends distal from the respective wall portions. Subsequently, unset concrete is poured onto the form plate to form a slab linking the four wall members. This floor slab is supported in two dimensions by all four wall members so that the strength required for each of the wall members is less than it would be had the floor slab been supported by only two of the members.

Another aspect of the invention is that it provides a method of making a monolithic concrete corner portion of a building, the corner portion comprising at least one horizontally extensive slab portion. The preferred method comprises providing at least two flanged wall members, each of which has a respective vertical wall portion having two respective vertical edges spaced apart by a width substantially the same as the selected width of one of the walls of the room that is being formed. Each of these wall members preferably comprises at least one respective horizontal flange extending away from the respective wall portion by no more than a respective selected flange width. Each of the preferred flanges has at least one beveled end adjacent one of the edges of the respective wall member. In the beveled end region the width of the flange decreases from the selected flange width to substantially zero at one end of the associated wall portion. Two of the wall members are then juxtaposed so that their respective wall portions are mutually perpendicular and so that respective beveled ends of the respective flanges are at a common horizontal level and are adjacent each other, thus forming what would be a corner portion of the building were it not for a necessary gap left between the two wall members. This gap is then filled by emplacing unset concrete between the wall portions and the adjacent flange portions of the two juxtaposed wall members and allowing the concrete to set so as to form the corner portion of the building.

Another aspect of the invention is that it provides an improvement to a structure comprising a horizontal floor extending between at least two vertical walls at a common bottom thereof and a ceiling extending between the at least two vertical walls at a common top thereof, wherein portions of the floor and the ceiling preferably have a common nominal flange thickness. This improvement is characterized in that each of the walls comprises at least one respective concrete member, which may be pre-cast or poured in situ, and that has at least one horizontal flange portion integrally formed with it and extending along it for a distance substantially equal to an intramural spacing between facing walls in the structure. Each of these flange portions preferably extends into a space between the walls by a selected distance that may be on the order of one meter. Each of the preferred flange portions has at least one reinforcing member extending from the flange portion into the space between the vertical walls. Both the floor and the ceiling of the preferred structure are made by connecting the two wall portions by means of a horizontal slab that may be formed in situ. As an alternate to forming the horizontal slab in situ, a pre-formed slab may be positioned between the two wall portions and joined thereto by grouting or by some other similar attachment technique.

Another aspect of the invention is that it provides several methods of making a portion of a building by pouring a concrete slab to connect at least two reinforced concrete wall members. This method comprises the steps of putting the walls in place (either by casting wall members in situ or by using pre-cast wall members), attaching a form plate to reinforced horizontal flange portions integrally formed with and extending outwardly from the respective wall portions, pouring unset concrete on the form plate to form the concrete slab and removing the form plate after the concrete has set. In some cases each of the wall members comprises a respective vertical wall portion and a respective horizontal flange portion extending toward the other of the walls, where each horizontal flange portion comprises a respective portion that is adjacent the associated wall portion and that has a selected thickness and a respective rabbeted end portion distal from the wall portion, each end portion having a reduced thickness substantially equal to one half the selected thickness. The form plate used in the preferred method has a size selected so that it can extend from beneath one of the two horizontal flange portions to the other and be held flush against their lower surfaces in a sealing relationship so as to retain the wet concrete within the form. In some variations of the method the form plate is temporarily attached to the flange portions by means of a plurality of bolts, each of which is passed through a respective throughhole in one of the horizontal flange portions. In another embodiment of the method, the form plate is supported by means of a space truss temporarily attached between the wall portions by means of elongated support members extending through horizontal holes formed in the wall portions. In some embodiments of the method the truss and form plate may be braced by brace members supported by lower portions of the structure being erected.

DETAILED DESCRIPTION OF A PREFERRED EMBODIMENT

Figure 1:
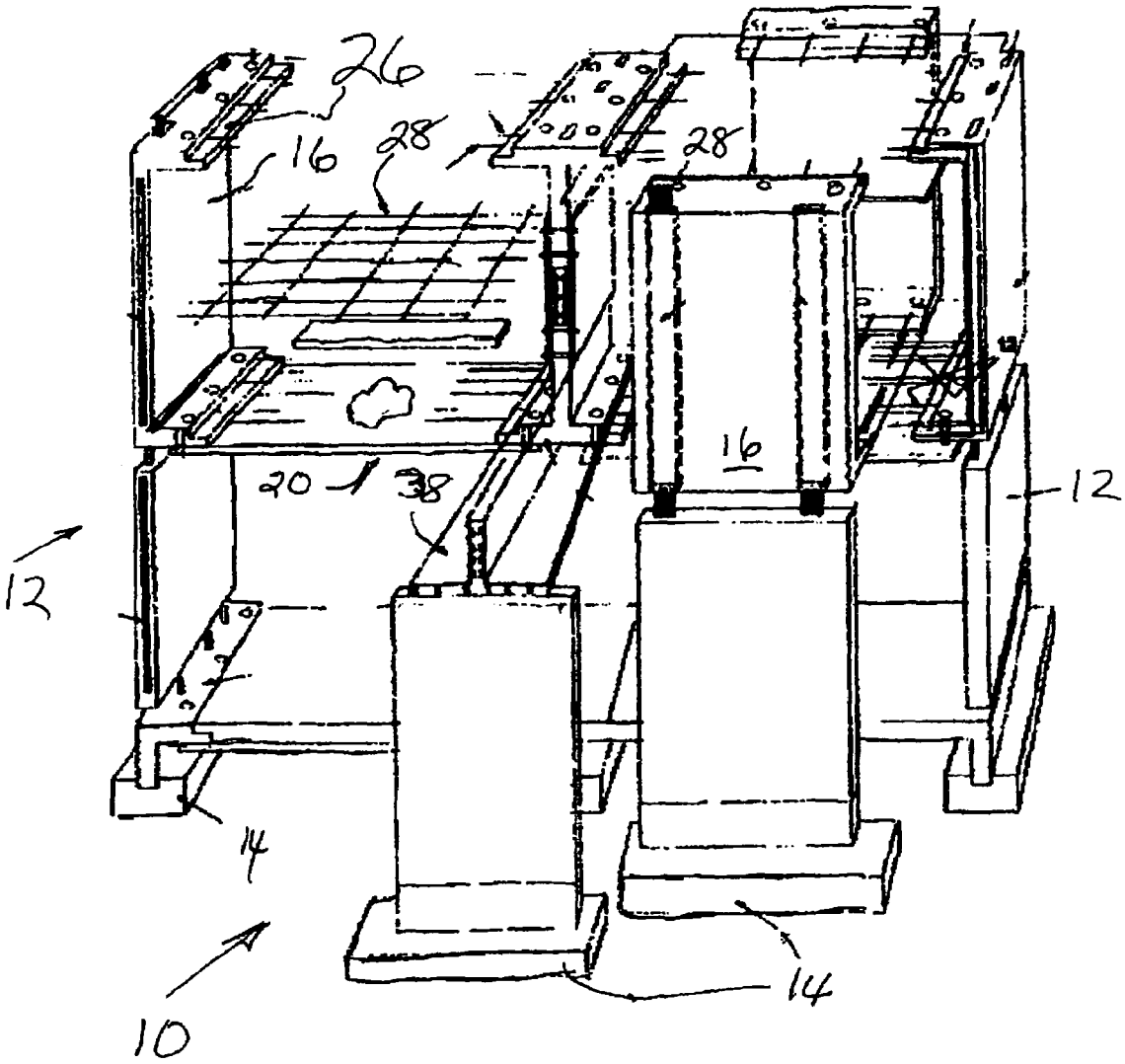
FIG. 1 is an exploded elevational view of a portion of a building constructed according to a preferred embodiment of the invention.

FIG. 1 depicts an exploded view of a portion of a building 10 made in accordance with the invention and using various combinations of pre-cast and cast-in-situ concrete portions. Although the depiction of FIG. 1 shows walls 12 erected on concrete footings 14, those skilled in the building arts will recognize, after reading the ensuing disclosure, that other foundation arrangements, such as a poured foundation slab (not shown) are also compatible with the invention.

In some embodiments of the invention, the wall members 12 are pre-cast for subsequent on-site assembly with floor and ceiling slabs that may be either pre-cast or poured in situ. In a particular preferred embodiment, both the wall members 12 and the linking slabs 30 used for floors and ceilings are all cast in situ in a preferred process that will be disclosed subsequently herein. The wall members 12, in particular, may be formed by casting concrete into a suitable mold or form. Because each wall member 12 of preferred embodiments of the invention comprises at least one horizontal flange portion 26 extending outward from the associated wall portion, the laterally extending portions of the form must be supported while the poured concrete cures.

Figure 2:
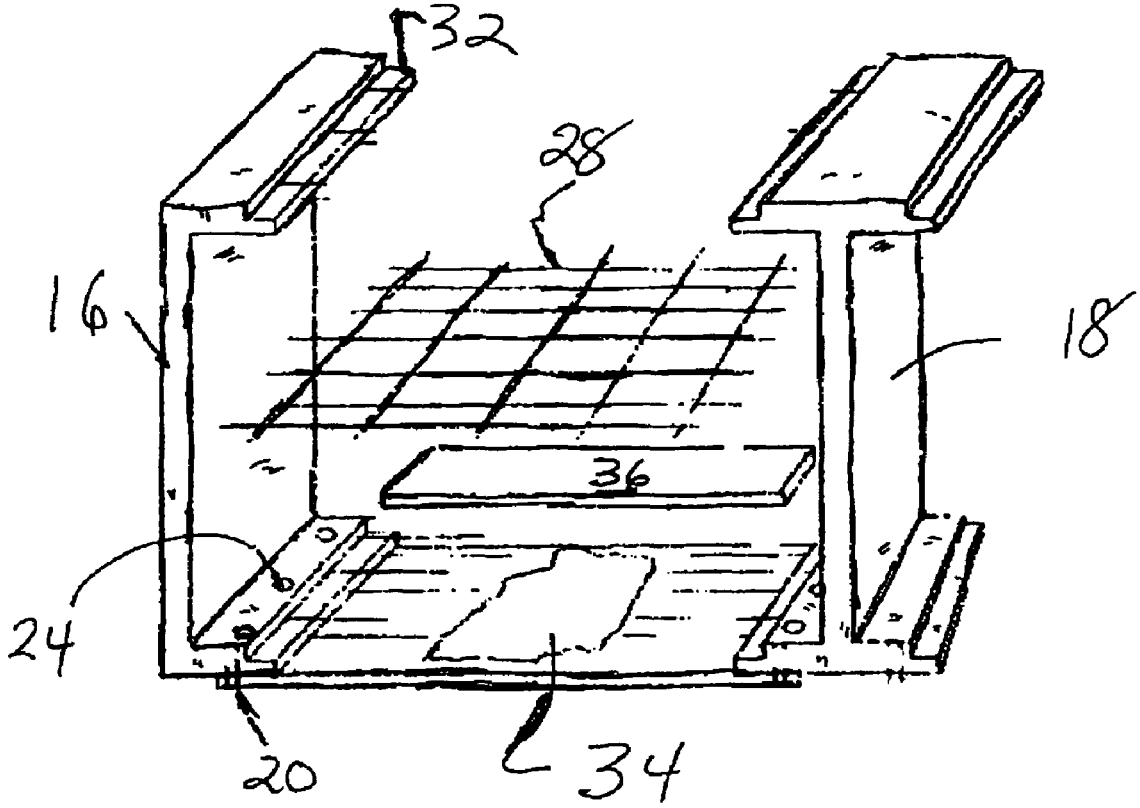
FIG. 2 is a detail view of a portion of FIG. 1 depicting an arrangement for linking an outside wall member to an interior wall member by pouring a horizontal slab portion in-situ.
Figure 6:
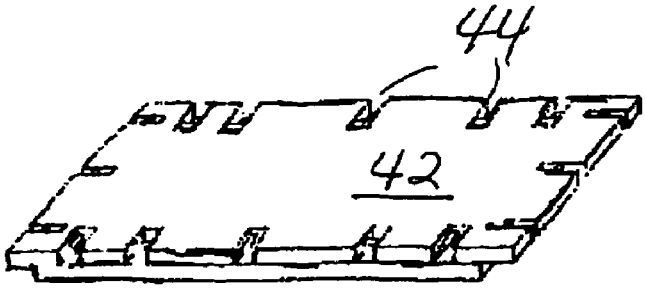
FIG. 6 is an elevational view of a pre-cast horizontal slab.

FIG. 2 shows details of a portion of the building of FIG. 1 in which a pre-cast exterior wall member 16, having a C-cross section, is connected to an I-section pre-cast interior wall member 18 by a form plate 20 temporarily attached in a sealing relationship between respective flange portions of the wall members 16, 18 by bolts 22 inserted through pre-formed throughholes 24. Each of the flange portions 26 preferably extends about ten to twenty percent of the distance between facing walls—i.e., about one meter away from its associated wall member. For most of this distance the flange portion 26 has a thickness matching the selected thickness for the final horizontal slab 30 that will connect facing wall members. The flange portion end 32 distal from the wall has a reduced thickness that aids in connecting the flange portion to other portions of the structure, as will be described hereinafter in greater detail. In a particular preferred embodiment, the reduced thickness end 32 of the flange portion has a thickness approximately half that of the thickness selected for the final horizontal slab, and extends about twenty centimeters inward from the distal end of the flange portion. Reinforcing bar 28 preferably runs through the flange portion 26, or is inserted thereinto by at least a development length. In a preferred embodiment, the bar 28 extends outwardly into the void formed by the reduced thickness of the flange portion end 32.

Figure 8:
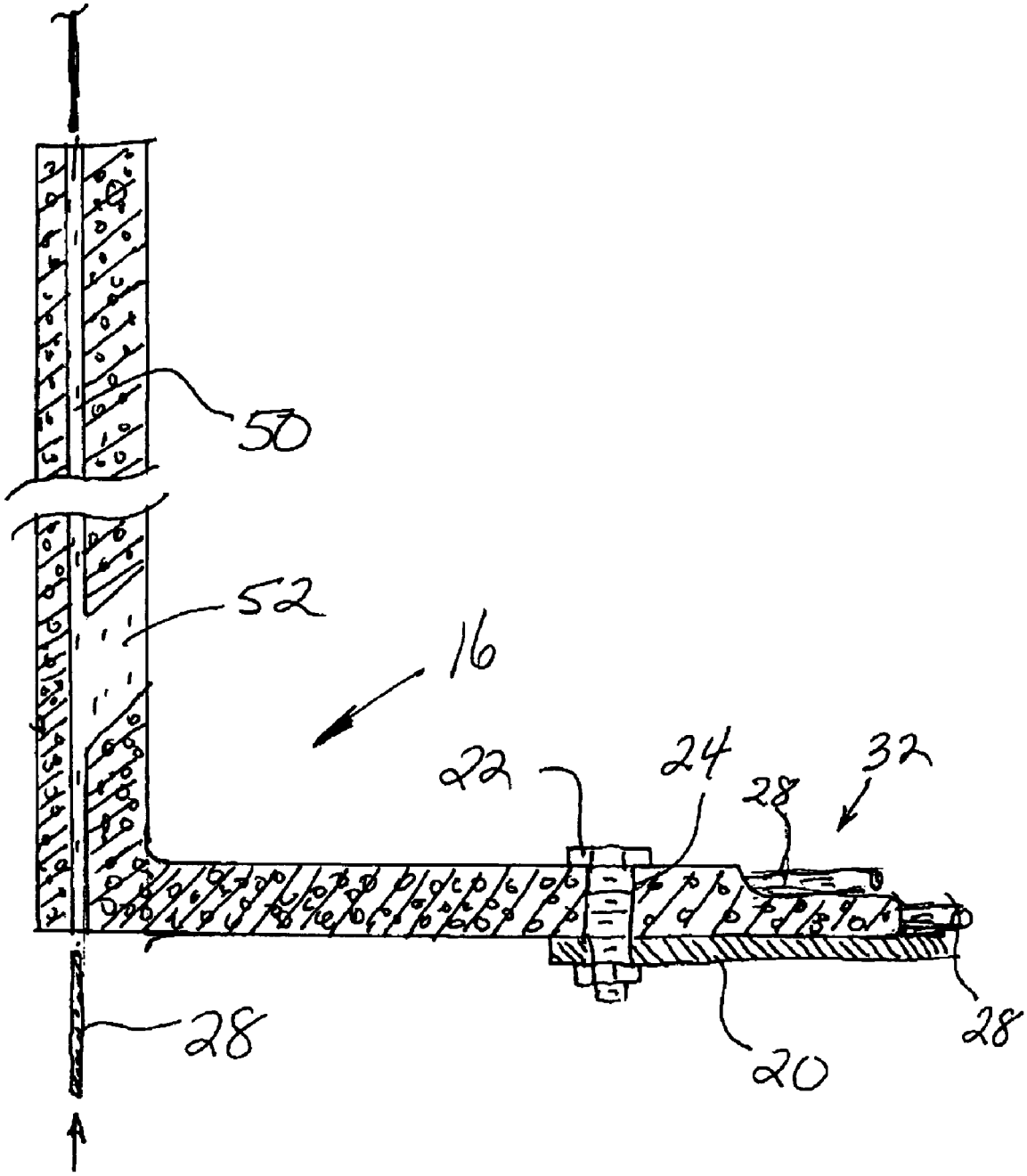
FIG. 8 is a cross-sectional view of a wall member of the invention.

In the depiction of FIG. 2, a grid of steel reinforcing bars 28 is placed above the form 20 so as to extend across a generally rectangular void extending between the flange end portions 32. Unset concrete is then poured onto the form 20 so as to form a completed slab 30. As is known in the art, low density material 34, such as empty cardboard boxes or plastic foam pellets, may be added before the concrete is poured. In addition, known thermal barrier materials 36 can also be added to the horizontal slab being formed in situ. When the horizontal slab is cast in situ, reinforcing steel 28 preferably projects outward from the flange portion end 32 by at least a development length, as depicted in FIG. 8.

Figure 3:
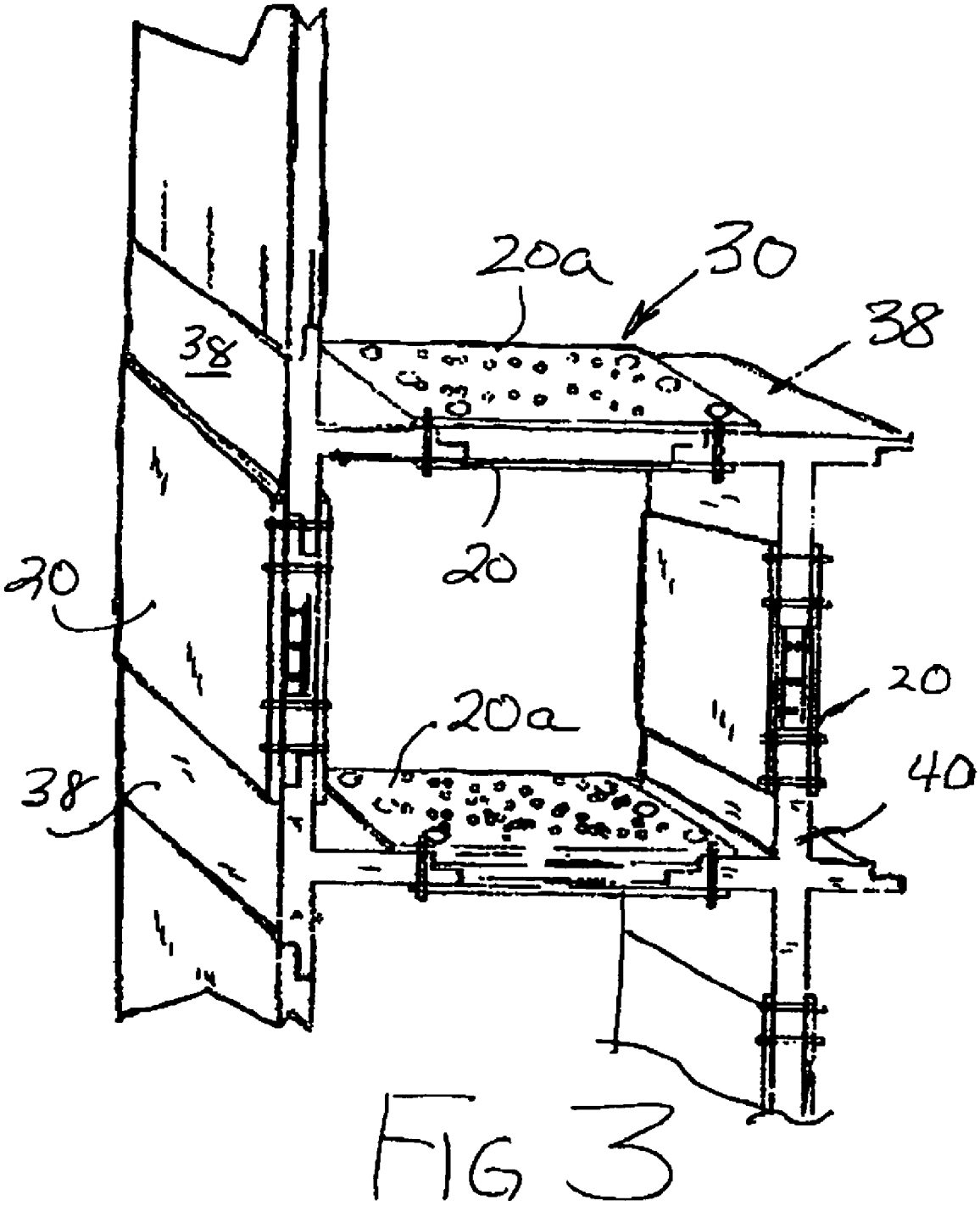
FIG. 3 is an elevational view depicting an arrangement for forming both portions of vertical walls and a horizontal slab by casting concrete in situ.

Turning now to FIG. 3, one finds an arrangement of the invention for casting both portions of walls and horizontal slabs in situ. In this depiction a pre-cast wall member having a T-cross section 38 is initially connected to a member having a cross or "plus sign" cross section 40 by both a bottom form plate 20 and an upper form plate 20*a* that is perforated to permit the inflow of concrete during a pour. Similarly, a vertical wall 12 is formed by linking two adjacent T-sections by means of appropriate form plates 20 and then pouring concrete into the wall space between them.

Figure 4:
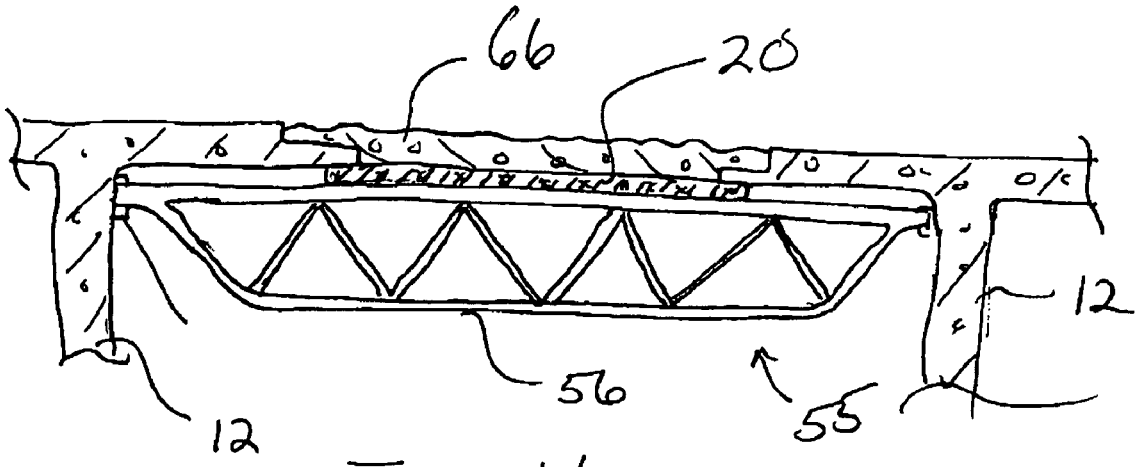
FIG. 4 is a partially sectional view of a truss joist arrangement for supporting a form used in casting horizontal slabs in situ.
Figure 5:
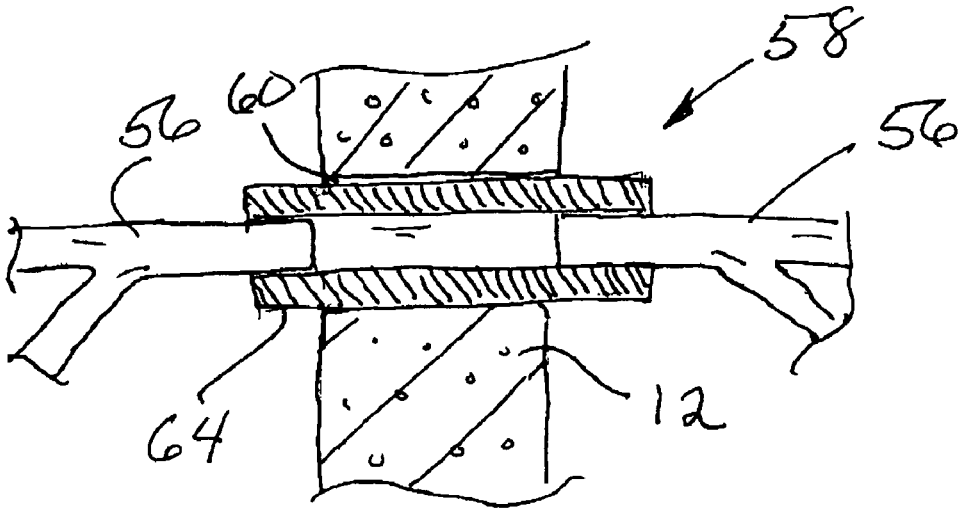
FIG. 5 is a sectional detail view of an arrangement for linking truss joists through an intervening wall member.

A preferred arrangement for pouring a slab that links two wall members into a monolithic structure is depicted in FIGS. 4 and 5. Initially two parallel facing wall portions of respective wall members are emplaced, either as pre-cast members or by an in situ pouring arrangement. Then a temporary joist 55 is put in position to support a form plate 20 so that it is sealed against the bottoms of both flanges. As is known in the art, the form plate may be a piece of plywood or other suitable form material. This joist preferably comprises a truss 56 and suitable supporting means 58 coupling the truss 56 to a wall 12. In one preferred embodiment the supporting means 58 is made by forming a horizontal throughhole 60 in the wall 12 (e.g., by casting a soft, sacrificial plug 62 into the concrete wall 12 and then reaming out the plug after the concrete has cured) and then inserting a heavy-walled piece of pipe 64 into the throughhole. By sliding the pipe 64 to and fro in the hole 60, one can work the ends of trusses 56 into the pipe 64 in order to transfer a portion of the loads from two slab pours 66 to the wall portion between them.

The system of the invention is not limited to arrangements for forming slabs cast in situ. A pre-cast slab 42 can be formed to fit in a space defined by two or more facing wall members. This slab 42 is preferably made with a reduced thickness edge portion 44 arranged to overlap the reduced thickness edge portion of the wall flanges 26 so that it can be placed on the wall flanges to form a smooth flat floor. In these cases, reinforcing bars formed into the wall member can only project beyond the flange portion end 32 if corresponding grooves or notches are provided in the pre-cast slab. In one preferred embodiment the slab 42 has a plurality of notches 44 formed in one or more sides and arranged so that the ends of the reinforcing members in the slab 42 are between ones of the notches. After a slab of this sort is put in position, the notches 44 and the clearance gap between the slab and the full thickness portion of the wall flange are filled with concrete to grout the slab to the wall members and to thereby form a monolithic structure.

Figure 7:
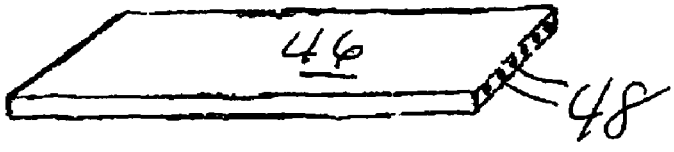
FIG. 7 is an elevational view of an alternate pre-cast horizontal slab.

Alternately a preformed slab 46, as depicted in FIG. 7, can be pre-cast with a plurality of hollow cores 48 running between opposing edges of the slab 46. Rebar can be inserted through these cores 48 at the job site, following which the slab 46 can be lowered into place between wall members and grouted.

In order to tie together the various members that make up a wall, rebar 28 may be inserted through vertical cores or channels 50 formed in pre-cast wall members. When an entire wall is formed from pre-cast members, channels 50 in all the members are arranged to be aligned so that long horizontally and vertically disposed pieces of rebar can be used to connect multiple wall members. In addition, a preferred wall member 16 may comprise a grouting slot 52 communicating with the channel 50 in order to ensure the rebar 28 is firmly grouted in place from the bottom to the top of a multi-section wall. Alternately, wall sections can have rebar pre-cast into them with portions of the rebar extending outwardly from selected faces of the wall sections. In some embodiments, the reinforcing bar extends outward about thirty bar diameters. Channels in mating surfaces of other wall sections are then provided to receive the cast-in-place rebar.

When wall sections are cast in situ the rebar 28 is preferably put in place before casting the wall section. Those skilled in the art will recognize that other channels, such as may be used for electrical wiring and the like, can also be worked into walls of the invention, regardless of whether those walls are pre-cast or cast in situ.

By repeating various of the above steps so as to provide both top and bottom slabs, one produces an integrated concrete room having rigid corners (as additional steel is embedded in all corners).

In particularly preferred embodiments of the invention corner wall members 17 having mating beveled flanges are used to form outside corners. This is depicted schematically in FIG. 9, where four beveled C-section members 17 are shown in an exploded view. The beveled C-section wall members may be closely juxtaposed and then grouted together so as to define a partly enclosed volume having a flange portion of each of the members at common floor and ceiling levels. The distal ends of each set of four such flanges (e.g., those used for forming the floor) define a generally rectangular void that may be closed with a slab as previously herein disclosed.

Figure 9:
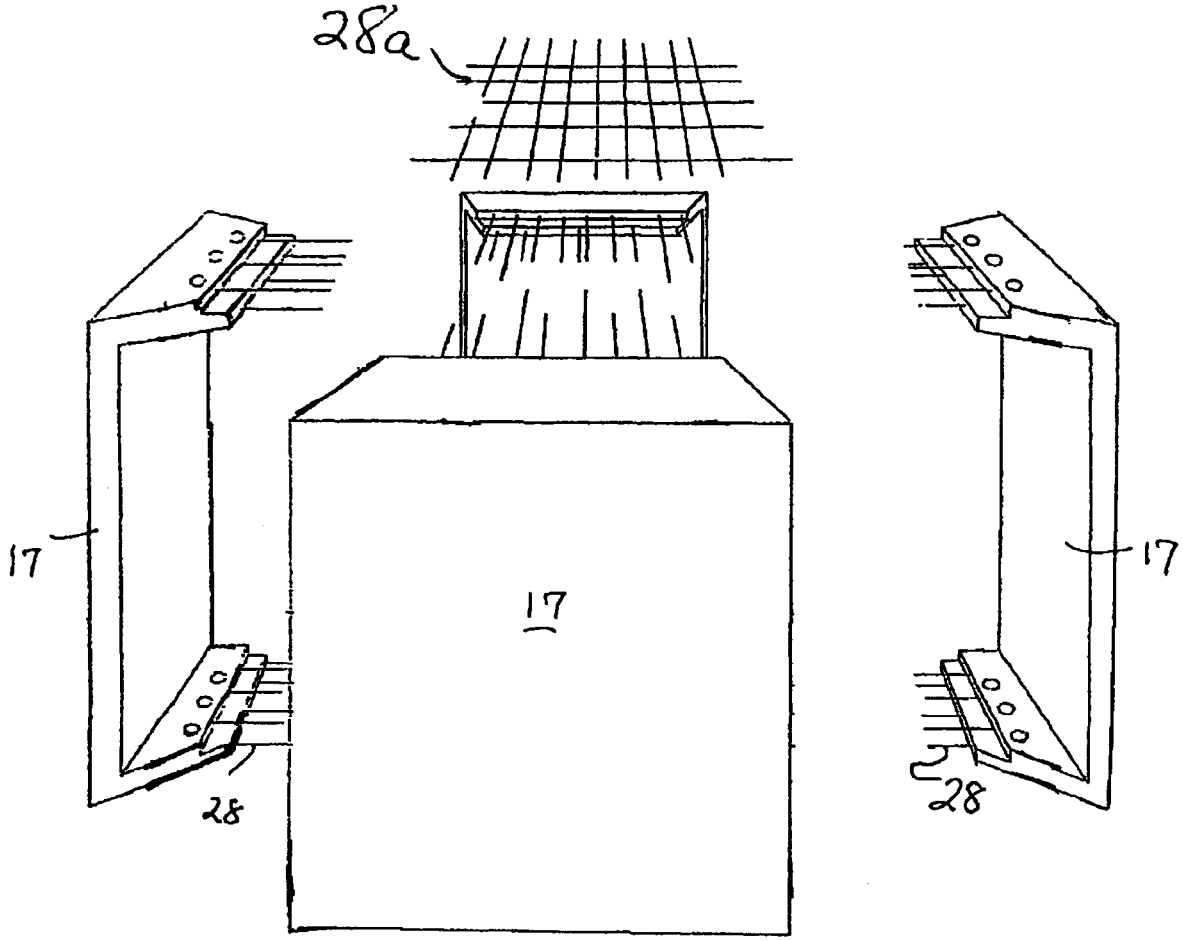
FIG. 9 is a schematic exploded view of four beveled wall members used for forming one or more an outside corners of a building.

The use of the beveled flanges allows for "2-way" support of the slab, which may be cast in situ over a grid or network of rebar 28*a* running in two perpendicular directions (e.g., as shown in FIG. 9). That is, the weight of the slab is supported, at all times, by all four of the wall members used for forming the room. This provides for load transfer and redistribution of moments between the room components and the adjoining slabs. This sharing of moment and deflection reduces both the moments and the deflection in the floor slab as part of the loads are now carried by the adjacent walls, slabs, and ceiling. Thus, one can use a substantially thinner slab and reduce the amount of concrete used in both the wall elements and the slab. Note that if the beveled wall modules are used with a custom-sized pre-cast slab having rebar running in two perpendicular directions that is placed on the rabbeted horizontal flange portions and grouted in, one would have the same load sharing arrangement with the quasi-continuous rebar running from the slab to the flange to the wall. When compared to the inventor's earlier work, as presented in his U.S. Pat. No. 5,081,805, the present embodiments using pre-cast panels provide a weight reduction of about 34%. This reduces both materials costs and the cost of operating cranes used for lifting the panels into place.

In embodiments of the invention using the C- and I-section members, as depicted in FIG. 2, the joints between various concrete members are all in the floors and ceilings of finished rooms. The prior art approach taught in U.S. Pat. No. 5,081,805 resulted in joints halfway up the wall in each room. Concealing these joints is labor intensive and expensive. This cost is avoided when the joints are routinely concealed by flooring or a conventional ceiling texture coating. Moreover, because the present method allows for more uniform placement of a greater number of rebars, concrete shrinking stresses in a poured slab are relatively uniform so that construction-induced lines are not problematic, even in an untextured ceiling.

The invention claimed is:

1. A method for making a monolithic reinforced concrete portion of a building comprising two vertical facing walls having a common wall length, the walls spaced apart by a selected intramural spacing, the method comprising the sequentially executed steps of:

a) erecting two flanged wall members, each of the two flanged wall members comprising a respective vertical wall portion having a horizontal width substantially equal to the wall length and having at least one horizontal flange portion extending outward therefrom by a selected horizontal length ranging between 10% and 25% of the selected intramural spacing, the wall members erected in a parallel facing relationship so that the two flange portions extend toward each other, each horizontal flange portion comprising a respective rabbeted end portion distal from its associated wall portion, each flanged wall member further having a respective at least one reinforcing member at least partly embedded therein, each reinforcing member extending along both the vertical wall portion and the horizontal flange portion of the respective wall member, each reinforcing member extending away from its associated vertical wall portion by more than the selected horizontal length so that a respective end of each of the reinforcing members distal from the associated wall portion extends outwardly from the respective rabbeted flange end portion;

b) supporting a form plate in a sealing relationship against a lower surface of each of the rabbeted end portions of the two horizontal flange portions by supporting means attached to both of the at least two wall members;

c) pouring concrete onto the form plate to form a slab linking the two wall members so as to make the monolithic reinforced concrete portion of the building.

2. The method of claim 1 wherein the supporting means comprises a plurality of bolts, each of the bolts inserted through a respective throughhole in one of the flanges.

3. The method of claim 1 wherein the supporting means comprises a truss disposed beneath the form plate, the truss having two ends, each of the two ends of the truss coupled to a respective one of the two wall portions by removable coupling means extending into a throughhole in the respective one of the two wall portions.

4. The method of claim 1 wherein at least one of the wall members comprises a precast reinforced concrete member.

5. The method of claim 1 wherein at least one of the wall members is erected by being cast in situ.

6. The method of claim 1 wherein at least one of the wall members comprises an insulating body disposed within the respective vertical portion thereof.

7. The method of claim 1 wherein the slab comprises a portion of a ceiling of a first storey of the building and a portion of a floor of a second storey of the building and wherein the respective wall portion of each of the wall members extends both above and below the slab.

8. A method of making a monolithic concrete corner portion of a building, the corner portion comprising at least one horizontally extensive slab portion, the method comprising the steps of:

a) providing at least two precast flanged wall members comprising respective vertical wall portions having two respective vertical edges, each of the wall members comprising at least one respective horizontal flange extending away from the respective wall portion by a respective selected flange width, each of the flanges having at least one beveled end adjacent one of the edges of the respective wall member b) juxtaposing two of the at least two wall members so that the respective wall portions are mutually perpendicular and so that respective beveled ends of the respective flanges are at a common horizontal level and are adjacent each other;

c) emplacing unset concrete between the wall portions and the adjacent flange portions of the two juxtaposed wall members and allowing the concrete to set so as to form the corner portion of the building.

9. The method of claim 8 further comprising the steps of d) juxtaposing a third and a fourth wall member with the first and second wall members so as to form an enclosed portion of the building having four flange portions extending into the enclosed portion at the common horizontal level and having a generally rectangular void bounded by ends of the respective flanges distal from their respective associated wall portions;

e) supporting a form plate in a sealing relationship against a lower surface of each of the four horizontal flange portions so as to bridge the void;

f) pouring concrete onto the form plate to form a slab linking the four wall members, the floor slab supported in two dimensions by all four wall members, whereby the strength required for each of the wall members is less than it would be had the floor slab been supported by only two of the members.

10. The method of claim 8 wherein in one of steps e) and f) the concrete is poured to connect the respective flanges by means of precast slab.

11. The method of claim 8 wherein at least one of the floor and ceiling slabs comprises a slab cast in situ onto a form plate supported against the respective flanges.

* * * * *